US007263902B2

(12) United States Patent
Hsieh

(10) Patent No.: US 7,263,902 B2
(45) Date of Patent: Sep. 4, 2007

(54) REPLACEABLE ELECTRONIC SPANNER

(76) Inventor: Chih-Ching Hsieh, 235 Chung-Ho Box 8-24, Taipei (TW)

( * ) Notice: Subject to any disclaimer, the term of this patent is extended or adjusted under 35 U.S.C. 154(b) by 0 days.

(21) Appl. No.: 11/036,700

(22) Filed: Jan. 18, 2005

(65) Prior Publication Data

US 2006/0156832 A1 Jul. 20, 2006

(51) Int. Cl.
*B25B 23/14* (2006.01)

(52) U.S. Cl. ..... 73/862.21; 73/862.22; 73/862.23

(58) Field of Classification Search ..... 73/862.21
See application file for complete search history.

(56) References Cited

U.S. PATENT DOCUMENTS 6,234,051 B1 * 5/2001 Bareggi ..... 81/479

6,295,898 B1 * 10/2001 Hsieh ..... 81/177.8

* cited by examiner

*Primary Examiner*—Edward Lefkowitz
*Assistant Examiner*—Freddie Kirkland, III

(57) ABSTRACT

A replaceable electronic spanner comprises a spanner body; at least one electronic device being installed to the spanner body; each electronic device being installed with a display; at least one end of the spanner body being formed with an inserting opening; one side of the inserting opening being installed with a stain gauge which is connected to the electronic device; the electronic device calculating the variation of resistance of the stain gauge so as to get the twisting force value of the spanner and then displays the twisting force on the display; a display head having a driving portion; one end of the driving portion being extended with an insertion section capable of being movably inserted into the inserting opening so as to combine the spanner body to the sensing head.

6 Claims, 8 Drawing Sheets

REPLACEABLE ELECTRONIC SPANNER

FIELD OF THE INVENTION

The present invention relates to spanners, and particularly to a replaceable electronic spanner, wherein the sensing head is replaceable so that one spanner body with at least one stain gauge can be used to suit different display heads.

BACKGROUND OF THE INVENTION

In the prior art electronic spanner, the spanner is installed with an electronic device and stain gauge. The electronic device has the effect of measuring the resistance variation of the stain gauge so as to get the twisting force applied to the spanner from the variation of the resistance of the stain gauge. Thereby the user can know whether the screw means is too tight so as to destroy the screw means or too loose to be tightened to an object.

However the cost of the prior art electronic spanner is too high to be acceptable. Thereby the display head is fixed to the spanner body. The display head cannot rotate with respect to the spanner body. The sensing head is non-replaceable. Thereby as it is desired to use different hand tools, the stain gauge cannot be replaced. Thereby the user must buy a new hand tool with the stain gauge.

SUMMARY OF THE INVENTION

Accordingly, the primary object of the present invention is to provide a replaceable electronic spanner, wherein the sensing head is replaceable so that one spanner body with at least one stain gauge can be used to suit different display heads.

To achieve above objects, the present invention provides a replaceable electronic spanner which comprises a spanner body; at least one electronic device being installed to the spanner body; each electronic device being installed with a display; at least one end of the spanner body being formed with an inserting opening; one side of the inserting opening being installed with a stain gauge which is connected to the electronic device; the electronic device calculating the variation of resistance of the stain gauge so as to get the twisting force of the spanner and then displays the twisting force on the display; a display head having a driving portion; one end of the driving portion being extended with an insertion section capable of being movably inserted into the inserting opening so as to combine the spanner body to the sensing head.

The various objects and advantages of the present invention will be more readily understood from the following detailed description when read in conjunction with the appended drawing.

DETAILED DESCRIPTION OF THE INVENTION

In order that those skilled in the art can further understand the present invention, a description will be described in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
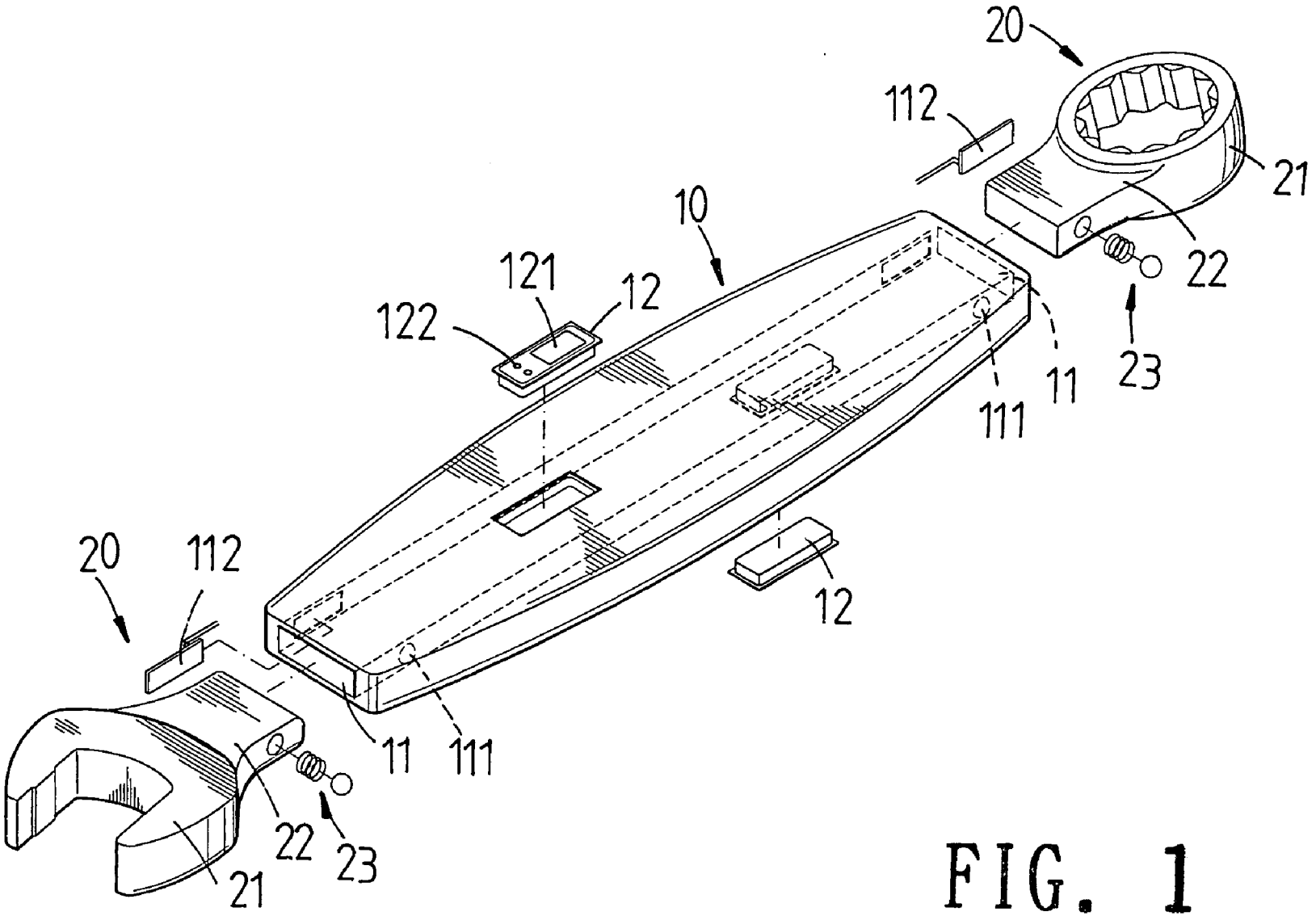
FIG. 1 is an exploded perspective view of the replaceable electronic spanner of the present invention.

Referring to FIG. 1, the replaceable electronic spanner of the present invention is illustrated. The replaceable electronic spanner of the present invention has the following elements. The replaceable electronic spanner has a spanner body 10 and a plurality of display heads 20 connected to ends of the spanner body 10. A front end of each driving head 2 can be installed with a driving portion 21. The driving portion 21 may be one of a ring driving portion, an opened end driving portion, and a ratchet driving portion. In this embodiment, from FIG. 1 to FIG. 4, an open ended driving portion is at one end of the spanner body 10 and a ring type driving portion is at another end of the spanner body 10.

Each of an upper side and a lower side of the spanner body 10 is embedded with an electronic device 12. A display 121 and a plurality of adjusting buttons 122 are installed on each electronic device 12. Each of a front end and a rear end of the spanner body 10 is formed with an inserting opening 11 for receiving a respective display head 20. One side of the inserting opening 11 has a buckling hole 111 and another side thereof is installed with a stain gauge 112 which is connected to and conductive to the electronic device 12. Thereby the electronic device 12 calculates the variation of resistance of the stain gauge 112 so as to get the twisting force of the spanner and then displays the twisting force on the display 121. The adjusting buttons 122 serves to calibrate and reset the electronic devices 12.

A front end of the display head 20 has the driving portion 21. One end of the driving portion 21 is extended with an insertion section 22 which has a shape corresponding to and smaller than the inserting opening 11. One side of the insertion section 22 has a buckling device 23 which is formed by a steel ball and an elastomer. When the insertion section 22 is inserted into the inserting opening 11, the buckling device 23 of the insertion section 22 is buckled into the buckling hole 111 of the inserting opening 11 so as to secure the display head 20 to the spanner body 10.

Figure 2:
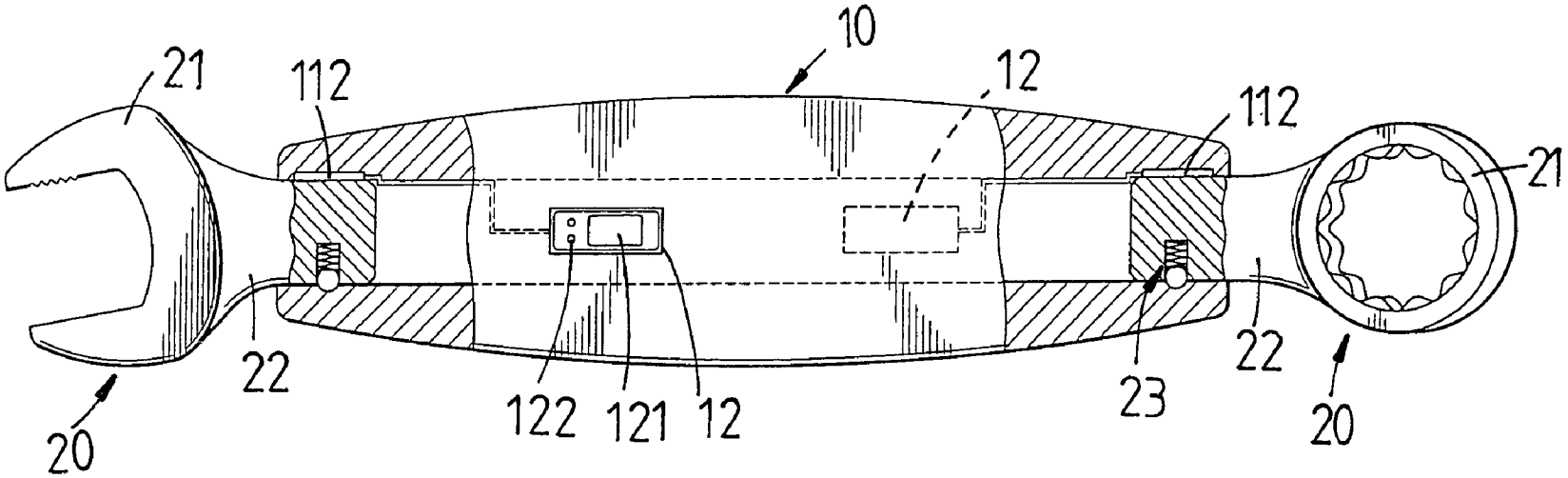
FIG. 2 is a cross sectional view of the replaceable electronic spanner of the present invention.
Figure 3:
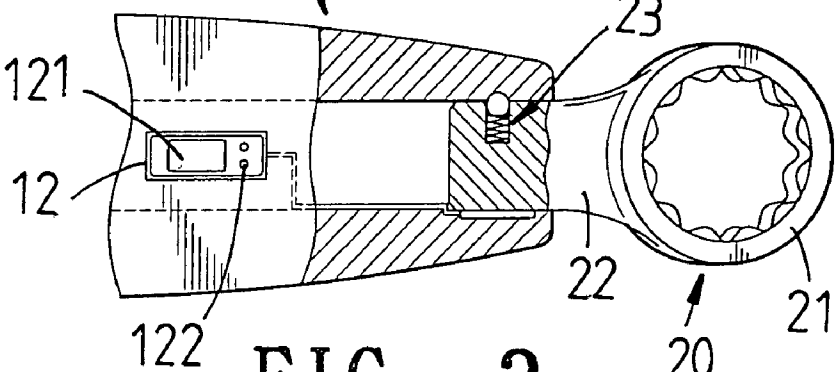
FIG. 3 is a partial cross sectional view of the replaceable electronic spanner according to the present invention.
Figure 4:
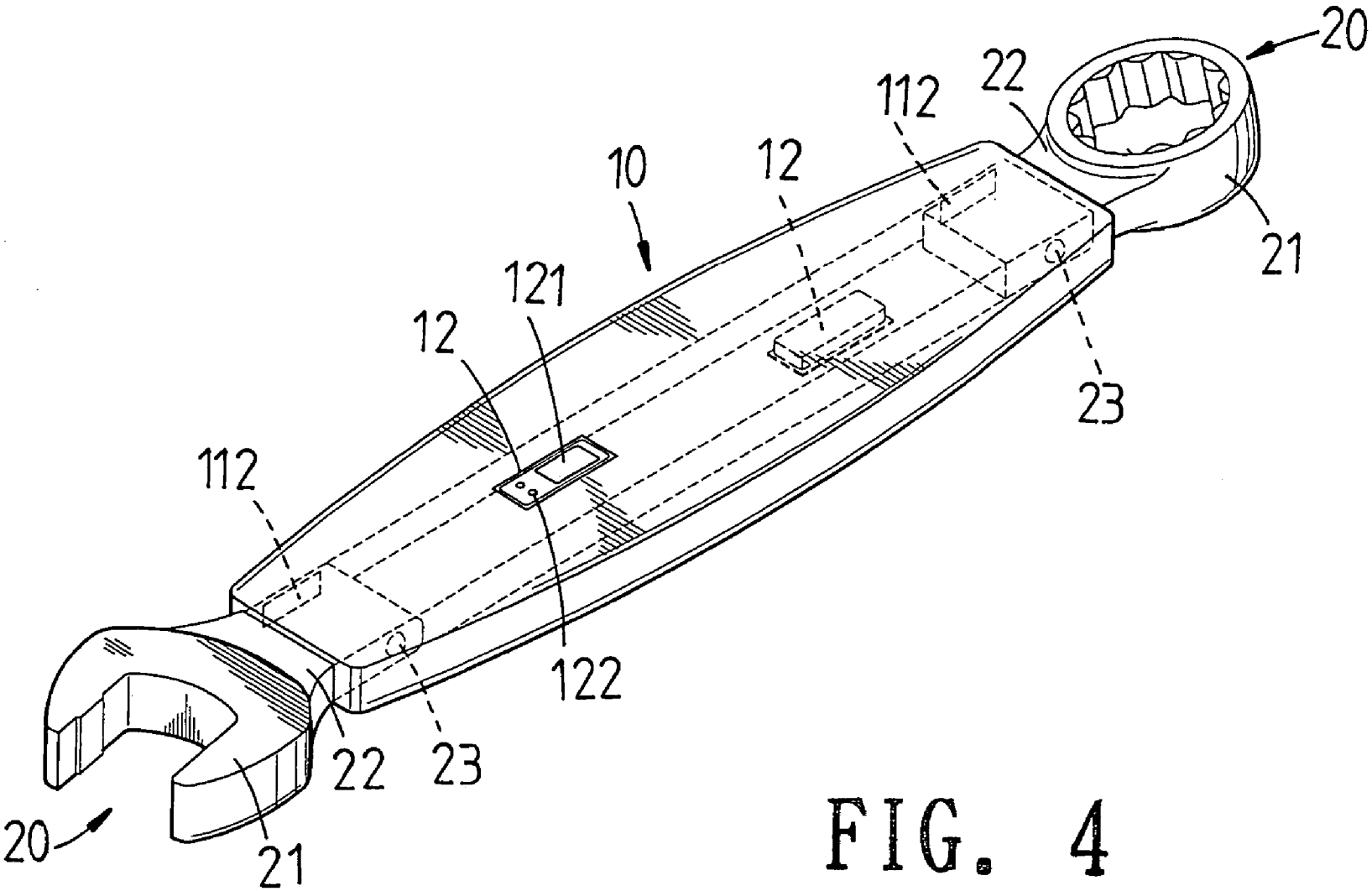
FIG. 4 is a perspective view of the replaceable electronic spanner of the present invention.
Figure 5:
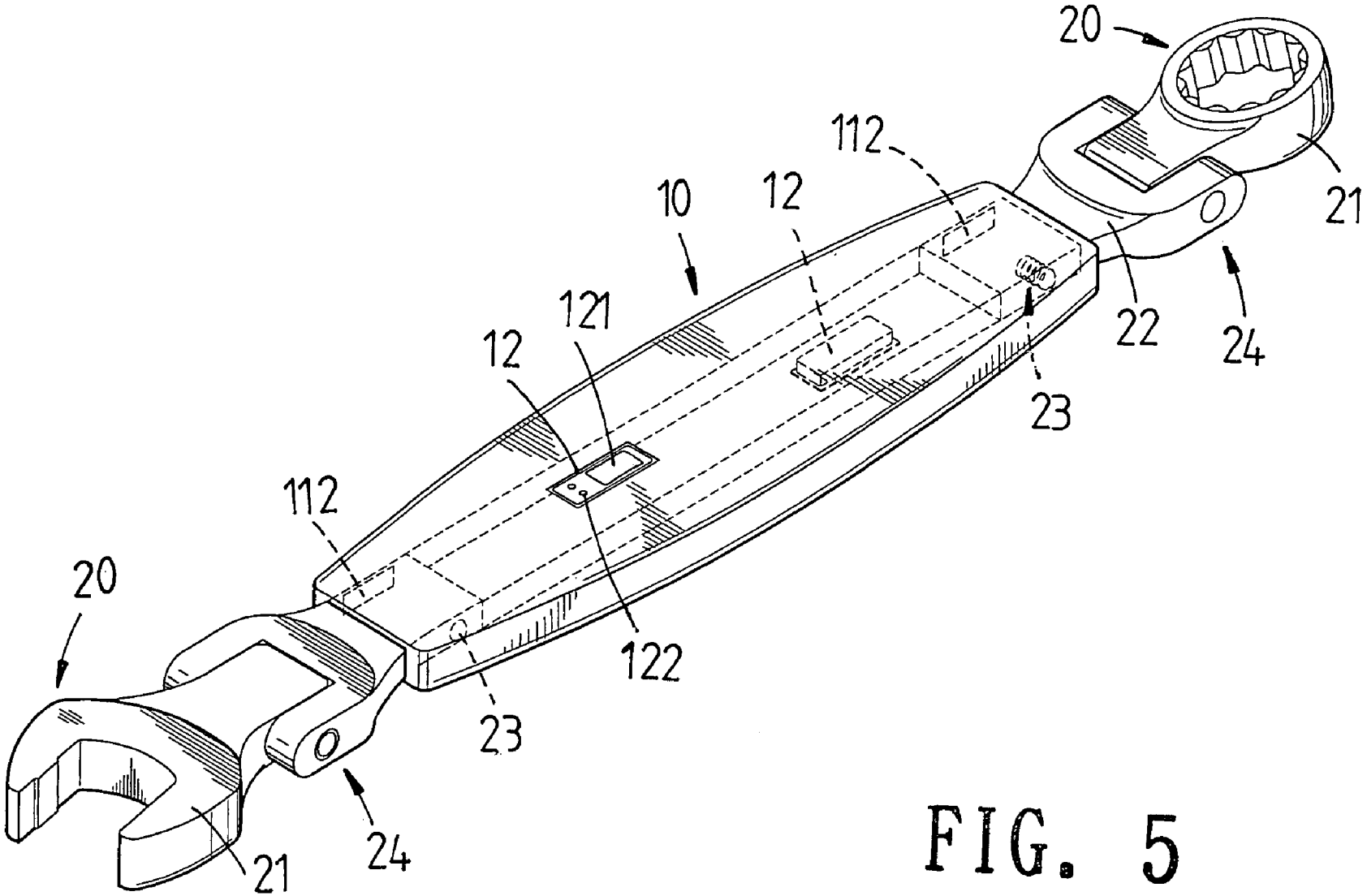
FIG. 5 is a perspective view of the second embodiment of the present invention.
Figure 6:
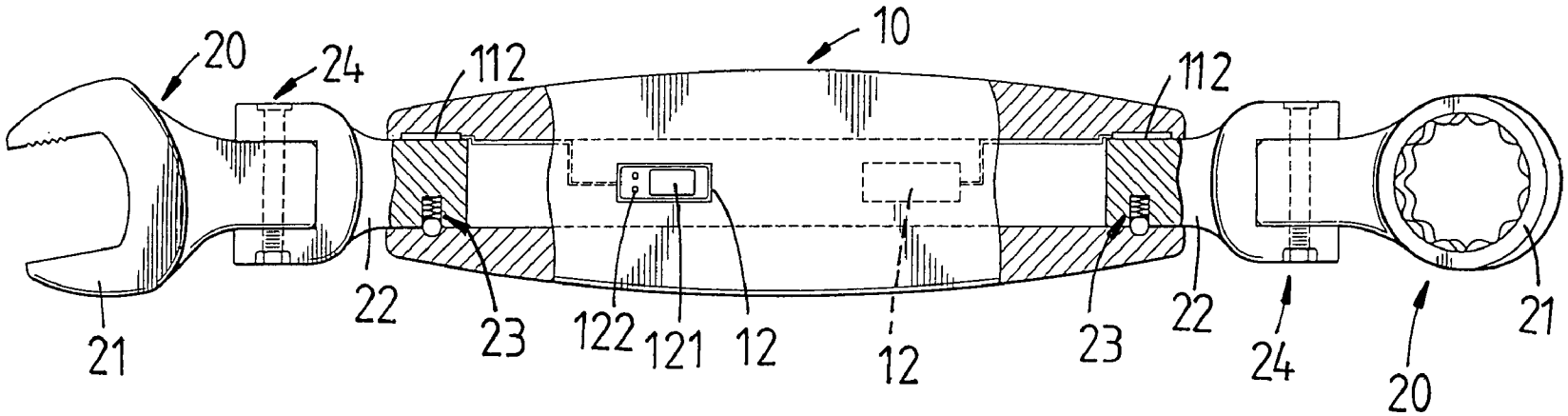
FIG. 6 is a transversal cross sectional view about the second embodiment of the present invention.
Figure 7:
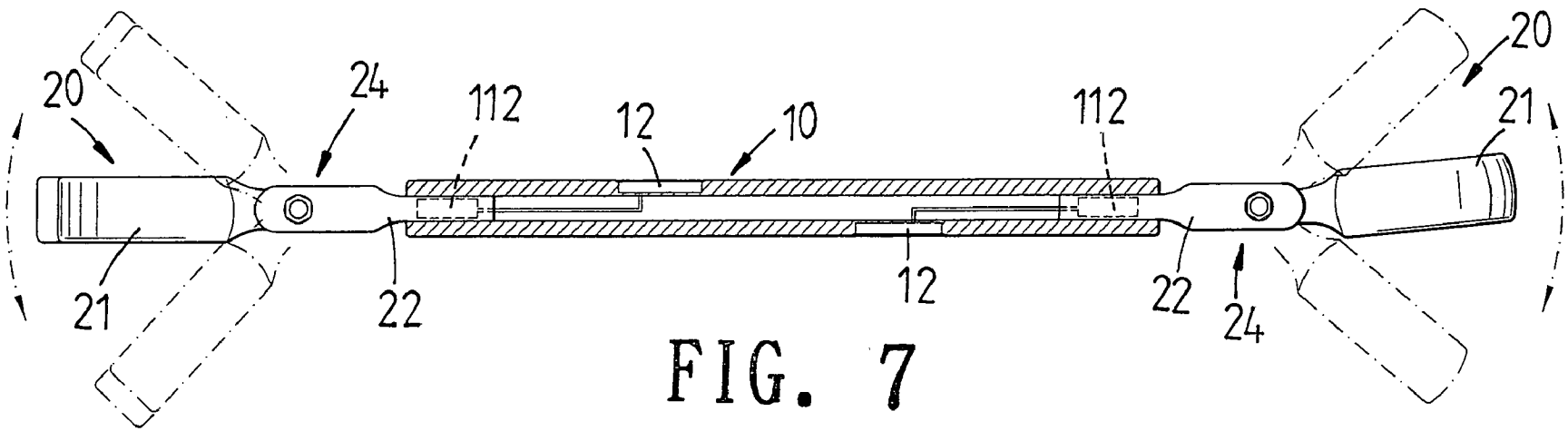
FIG. 7 is a longitudinal cross sectional view of the second embodiment of the present invention.
Figure 8:
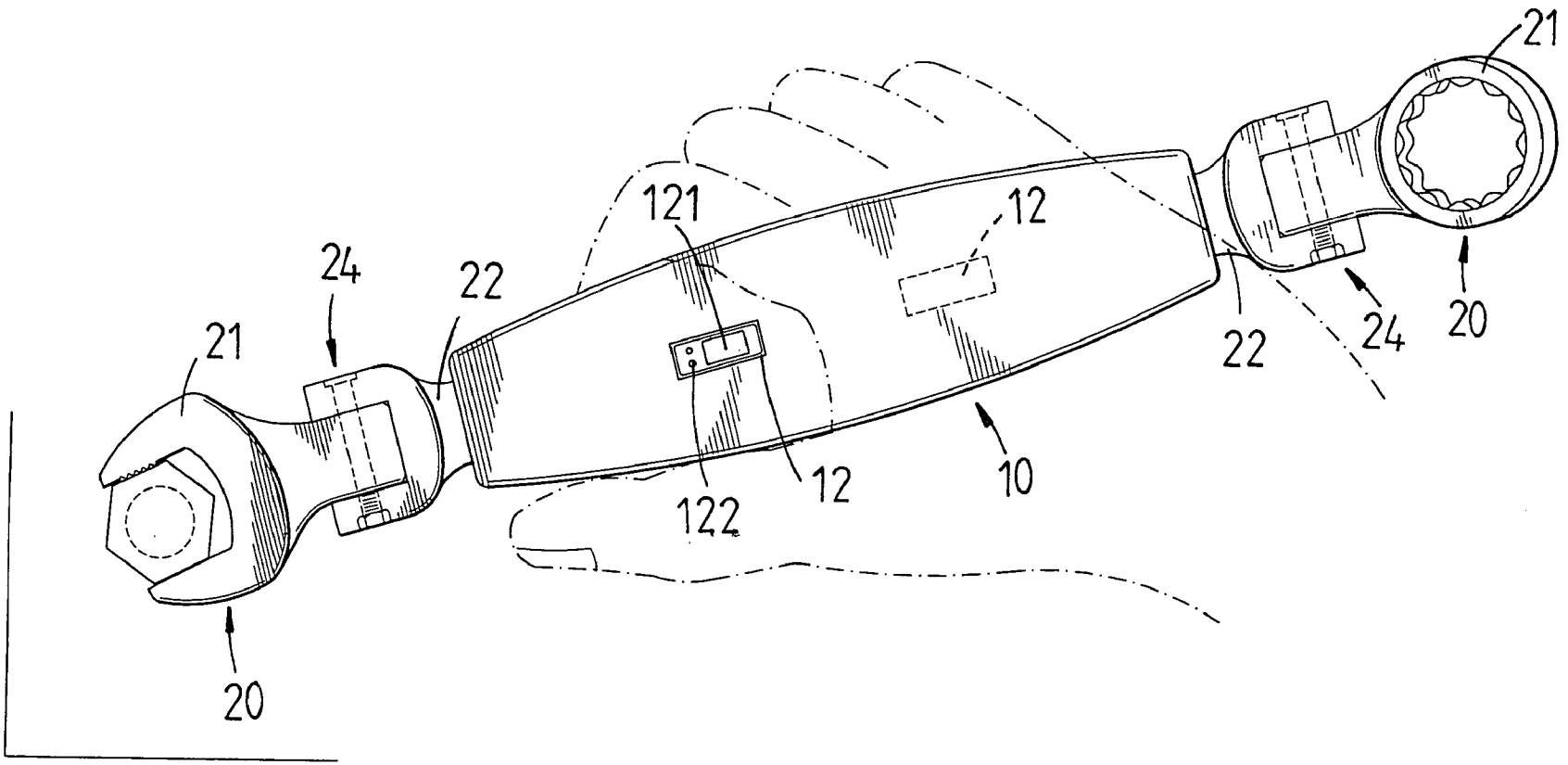
FIG. 8 is a longitudinal cross sectional view of the second embodiment of the present invention.
Figure 9:
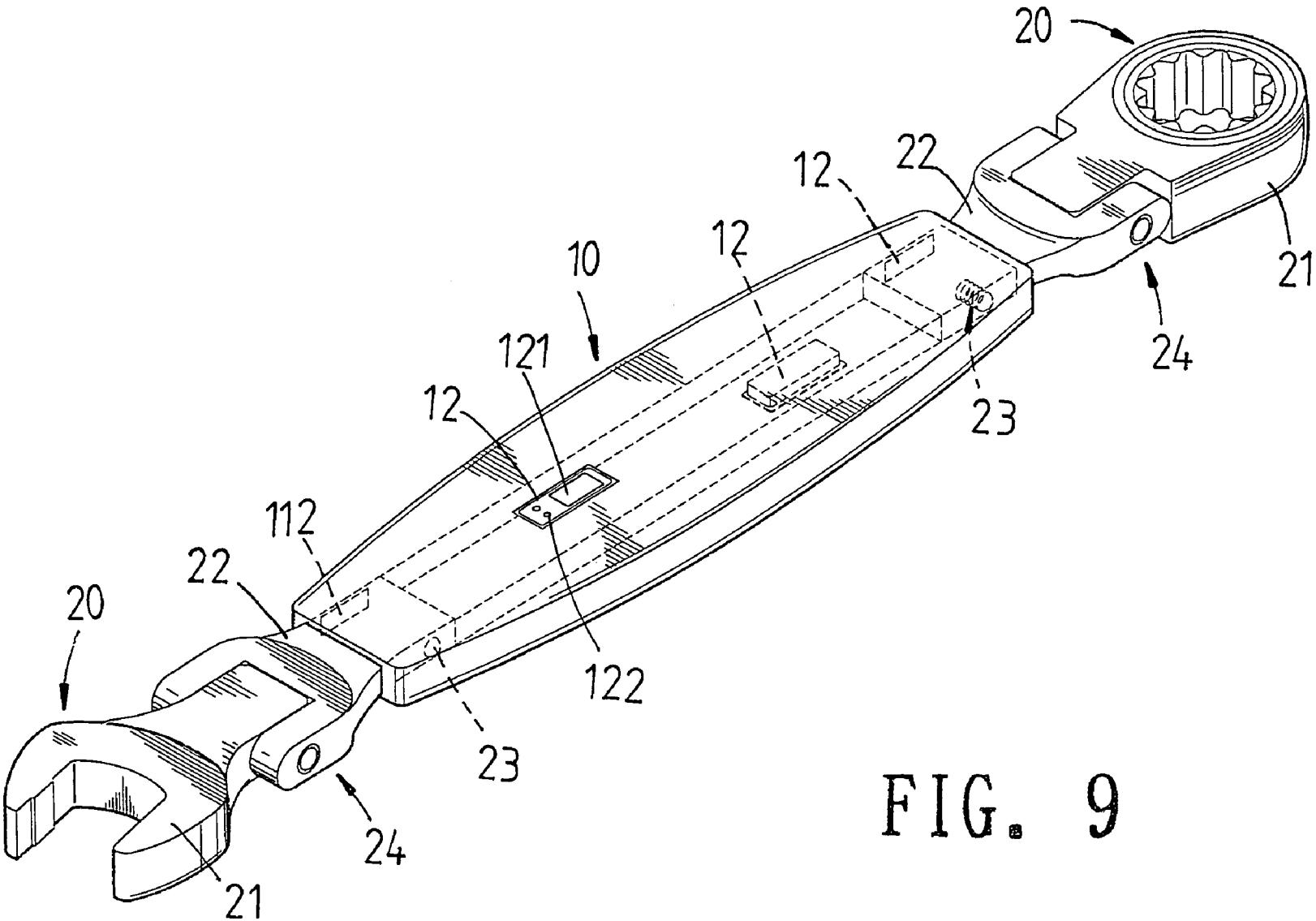
FIG. 9 is a perspective view of a third embodiment of the present invention.
Figure 10:
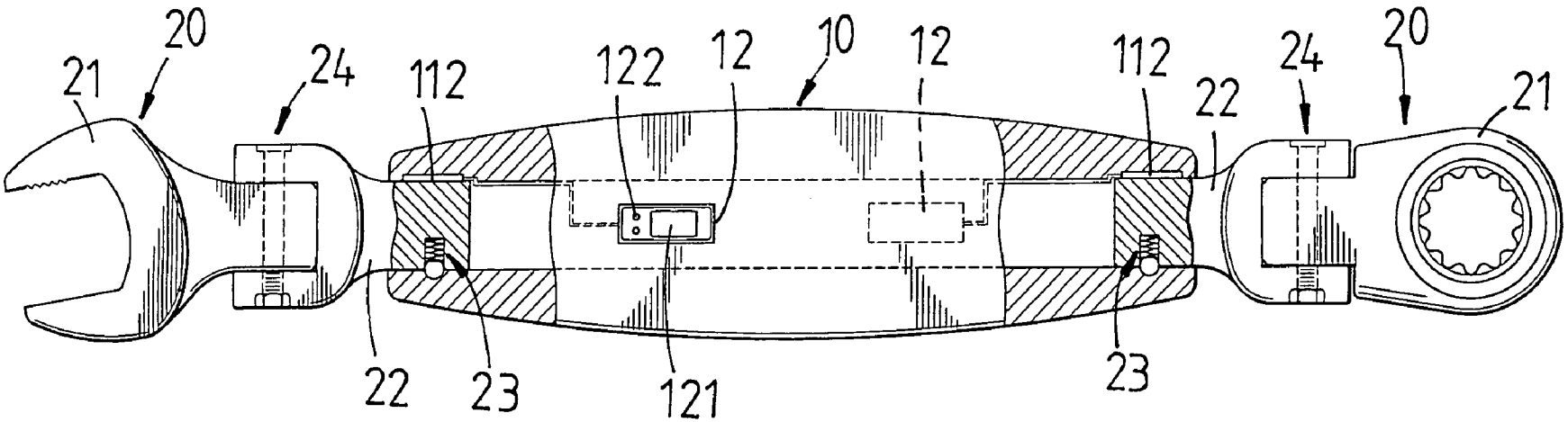
FIG. 10 is a transversal cross sectional view of the third embodiment of the present invention.

In use of the present invention, referring to FIGS. 2 to 4, the display head 20 is inserted into the inserting opening 11 so that the insertion section 22 of the display head 20 is inserted into the buckling hole 111 of the inserting opening 11 of the spanner body 10 so that the driving portion 21 is fixed to the spanner body 10. The stain gauge 112 at one side of the inserting opening 11 will tightly adhere to the insertion section 22 of the display head 20. When a screw means (not shown) is screwed by the spanner, the driving portion

21 of the display head 20 suffers from an external force, the display head 20 and spanner body 10 deforms slightly. Furthermore, the interior of the inserting opening 11 and the stain gauge 112 tightly adhered to the insertion section 22 still deform so as to change the resistance of the stain gauge 112. Thereby the electronic device 12 can calculate the twisting force, from the variation of the resistance and the twisting force is displayed on the display 121.

With reference to FIGS. 5 to 8, the second embodiment of the replaceable electronic spanner of the present invention is illustrated. The main components identical to those in the first embodiment will not be further described herein. In the present invention, a bending portion 24 is installed between the insertion section 22 and the driving portion 21 of the driving head 20. By the bending portion 24, the angle between the driving portion 21 and the spanner body 10 is adjustable. The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A replaceable electronic spanner comprising:

a spanner body; two electronic devices being installed to the spanner body; each electronic device being installed with a display; each of two ends of the spanner body being formed with an inserting opening; one side of each inserting opening being installed with a strain gauge which is connected to a respective one of the two electronic devices; the respective electronic device calculating a variation of resistance of the respective strain gauge so as to get a twisting force of the spanner and then displays the twisting force on the respective display;

two driving heads; each driving head having a driving portion; one end of each driving portion being extended with an insertion section capable of being movably inserted into the respective inserting opening so as to combine the spanner body to the driving head; and wherein the spanner body has two convex cambered opposite sides which are suitable for being held by a hand of a user; and wherein an inner side of each inserting opening of the spanner body is formed with a buckling hole; and each insertion section of the driving head is formed with a buckling device which is capable of being inserted into the buckling hole so as to fix the spanner body to the driving head; wherein the buckling device is a spring and a still ball.

2. The replaceable electronic spanner as claimed in claim 1, wherein a plurality of adjusting buttons are installed on the electronic device so as to calibrate or reset the electronic device.

3. The replaceable electronic spanner as claimed in claim 1, wherein the driving portion is an opened driving portion.

4. The replaceable electronic spanner as claimed in claim 1, wherein the driving portion 21 is a ring driving portion.

5. The replaceable electronic spanner as claimed in claim 1, wherein the driving portion is a ratchet driving portion.

6. The replaceable electronic spanner as claimed in claim 1, wherein a bending portion is installed between the insertion section of the display head and the driving portion.

* * * * *